US006746145B1

(12) United States Patent
Wu

(10) Patent No.: US 6,746,145 B1
(45) Date of Patent: Jun. 8, 2004

(54) DETACHABLE LAMP ASSEMBLY DEVICE WITH DETACHABLE ELEMENTS

(76) Inventor: Wen-Chang Wu, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 10/410,817

(22) Filed: Apr. 11, 2003

(51) Int. Cl.[7] ..... A41F 1/00

(52) U.S. Cl. ..... 362/581; 362/227; 362/374; 385/147; 385/901

(58) Field of Search ..... 362/227, 551, 362/558, 374; 385/85, 92, 116, 117, 129, 134, 137, 147, 900, 901

(56) References Cited

U.S. PATENT DOCUMENTS 3,613,048 A * 10/1971 Brundza ..... 439/275
4,557,554 A * 12/1985 Blanc ..... 385/88
5,317,485 A * 5/1994 Merjanian ..... 362/574
5,675,682 A * 10/1997 De Marchi ..... 385/77
6,168,304 B1 * 1/2001 Caruso ..... 362/581
6,502,966 B1 * 1/2003 Wu ..... 362/365
6,540,389 B1 * 4/2003 Novak et al. ..... 362/551

* cited by examiner

*Primary Examiner*—John Anthony Ward

(57) ABSTRACT

A detachable lamp assembly device comprises a lamp seat and a lamp rod. A U shape reduce portion is formed at two lateral sides and an upper surface of the lamp rod. A U shape embedding block covers upon the reduced portion. The U shape embedding block has a through hole at a position corresponding to the positioning hole. A top center of the embedding block has an elastomer. When the lamp rod inserts into the lamp seat, the elastomer will eject the embedding block upwards. Thereby, the embedding block will be buckled to the embedding hole; and thus the lamp seat is conductive to the lamp rod. A user can assemble the lamp rod by insetting it into the lamp seat easily; and thus, the lamp is detachable for storage and transfer with a smaller volume.

4 Claims, 5 Drawing Sheets

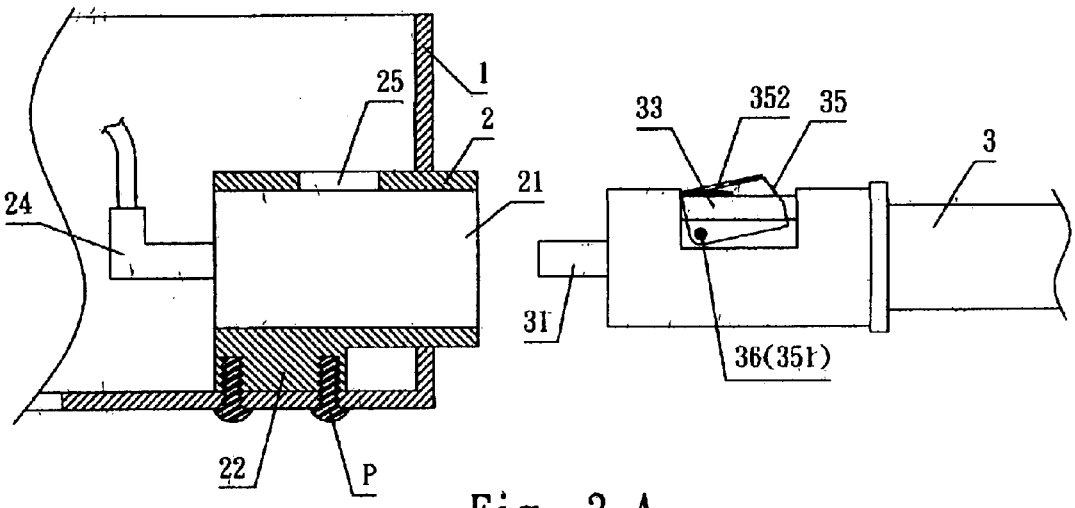
Fig. 3-A
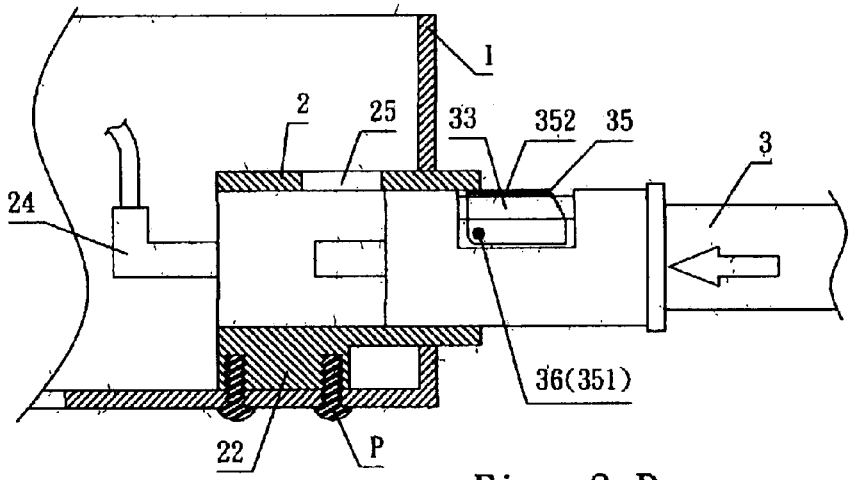
Fig. 3-B
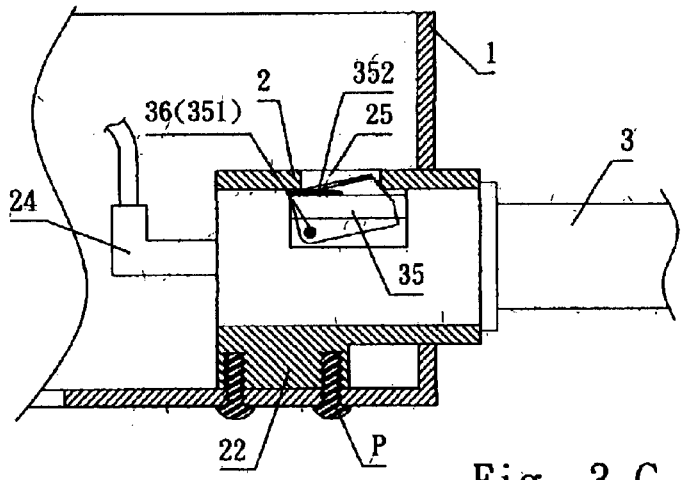
Fig. 3-C

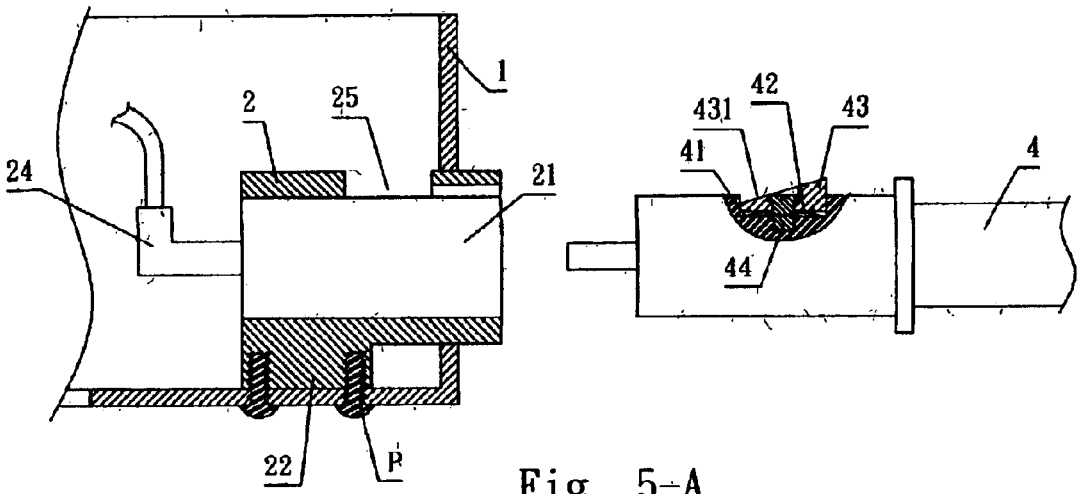
Fig. 5-A
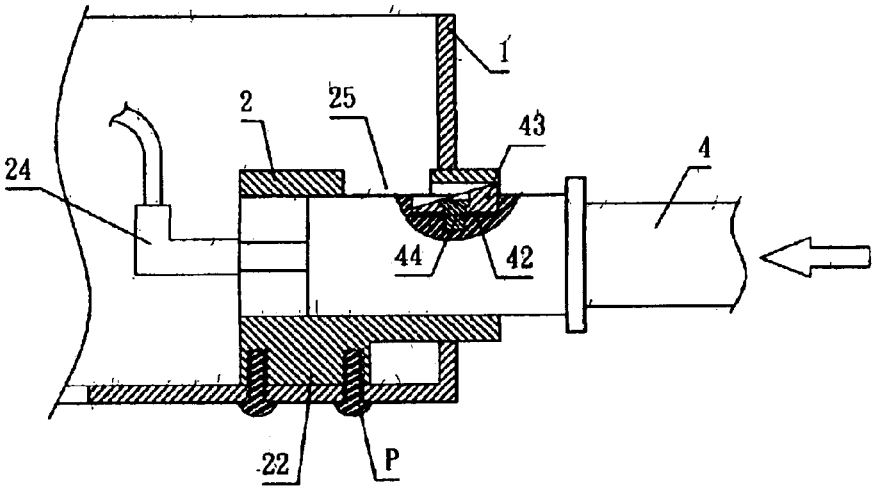
Fig. 5-B
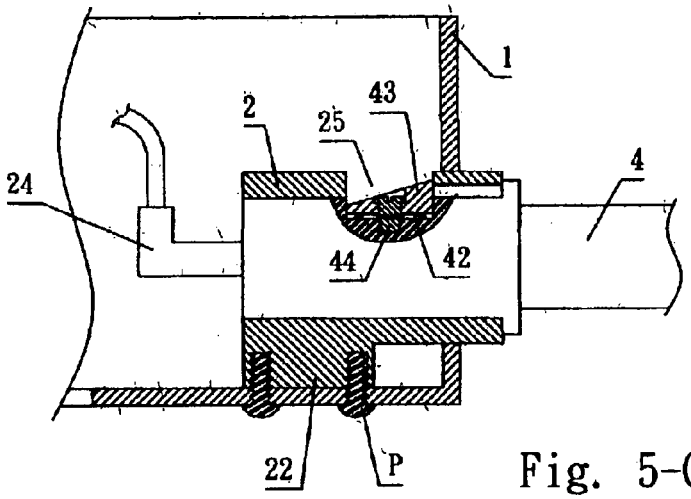
Fig. 5-C

DETACHABLE LAMP ASSEMBLY DEVICE WITH DETACHABLE ELEMENTS

BACKGROUND OF THE INVENTION

The present invention relates to lamp assembly devices, and particularly to a detachable lamp assembled device with detachable elements. By the design of the present invention, a user can assemble the lamp rod by inserting it into the lamp seat easily; thus, the lamp is detachable for storage and transfer with a smaller volume.

The prior art buckling structures of lamps, such as wall lamps, seat lamps, or stand lamps, are assembled by screwing studs with nuts. Not only collision events easy occur, but also the locking tools (for example, spanners, openers, etc.) are necessarily used in assembly. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention is to provide a detachable lamp assembly device which comprises a lamp seat firmly secured to a lateral side of a wire winding box, and a lamp rod inserted into the lamp seat. A U shape reduce portion is formed at two lateral sides and an upper surface of the lamp rod. A U shape embedding block covers upon the reduced portion. The U shape embedding block has a through hole at a position corresponding to the positioning hole. A top center of the embedding block has an elastomer. When the lamp rod inserts into the lamp seat, the elastomer will eject the embedding block upwards, the embedding block will be buckled to the embedding hole. When the lamp rod is inserted into the lamp seat, the end portion of the lamp rod exactly inserts into the inserting seat so that the lamp seat is conductive to the lamp rod. Hence, a user can assemble the lamp rod by inserting it into the lamp seat easily; thus, the lamp is detachable for storage and transfer with a smaller volume.

The various objects and advantages of the present invention will be more readily understood from the following detailed description when read in conjunction with the appended drawing.

BRIEF DESCRIPTION OF THE DRAWINGS

FIG. 3A shows one embodiment of the present invention before the insertion of the lamp rod.

FIG. 3B shows the embodiment of FIG. 3A wherein the lamp rod is insetting.

FIG. 3C shows the embodiment of FIG. 3A after the insertion of the lamp rod.

FIG. 5A shows the embodiment of FIG. 4 before the insertion of the lamp rod.

FIG. 5B shows the embodiment of FIG. 4 wherein the lamp rod is inserting.

FIG. 5C shows the embodiment of FIG. 4 after the insertion of the lamp rod.

BRIEF DESCRIPTION OF THE PREFERRED EMBODIMENTS

Figure 1:
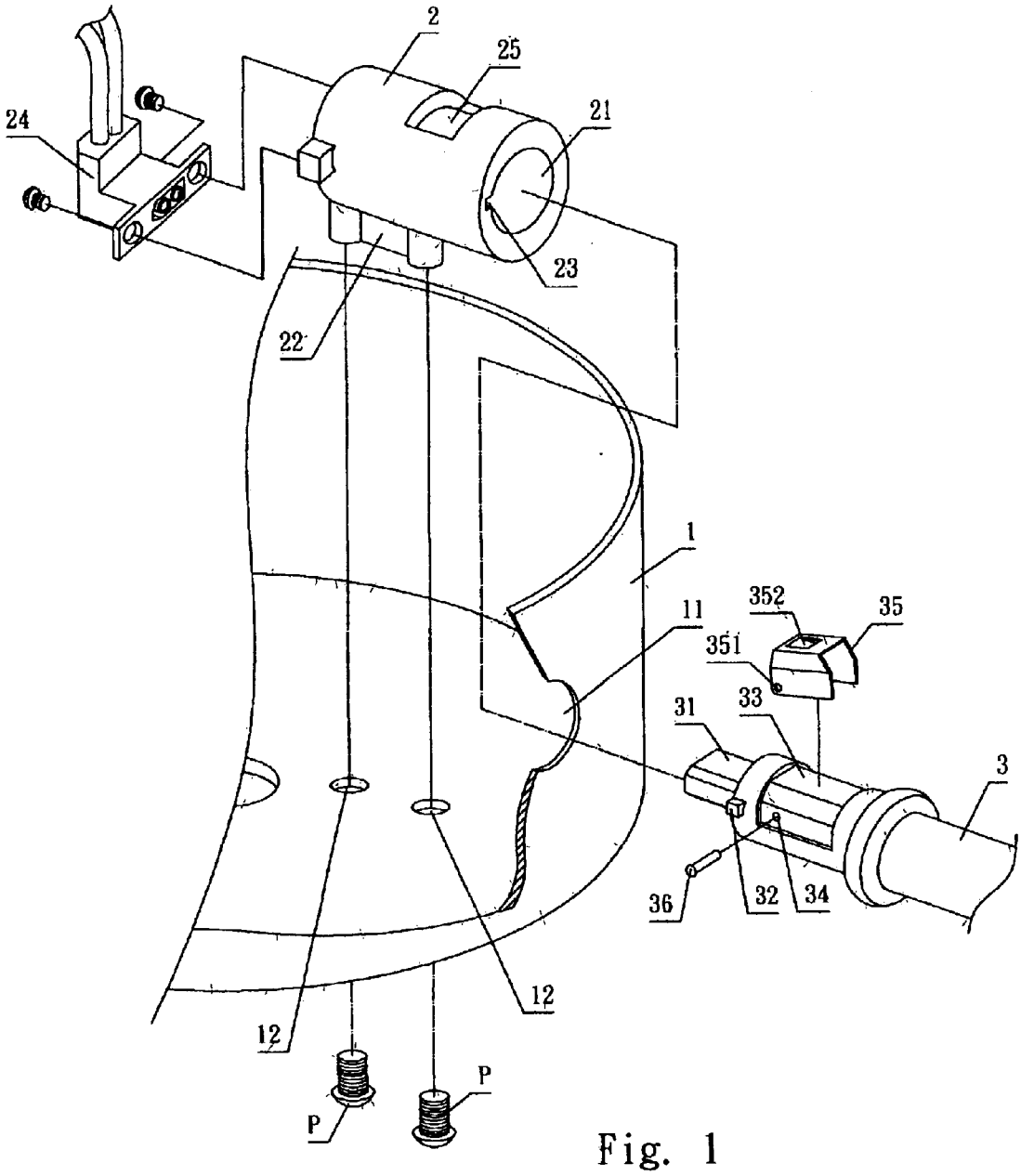
FIG. 1 is an exploded perspective view of the present invention.
Figure 2:
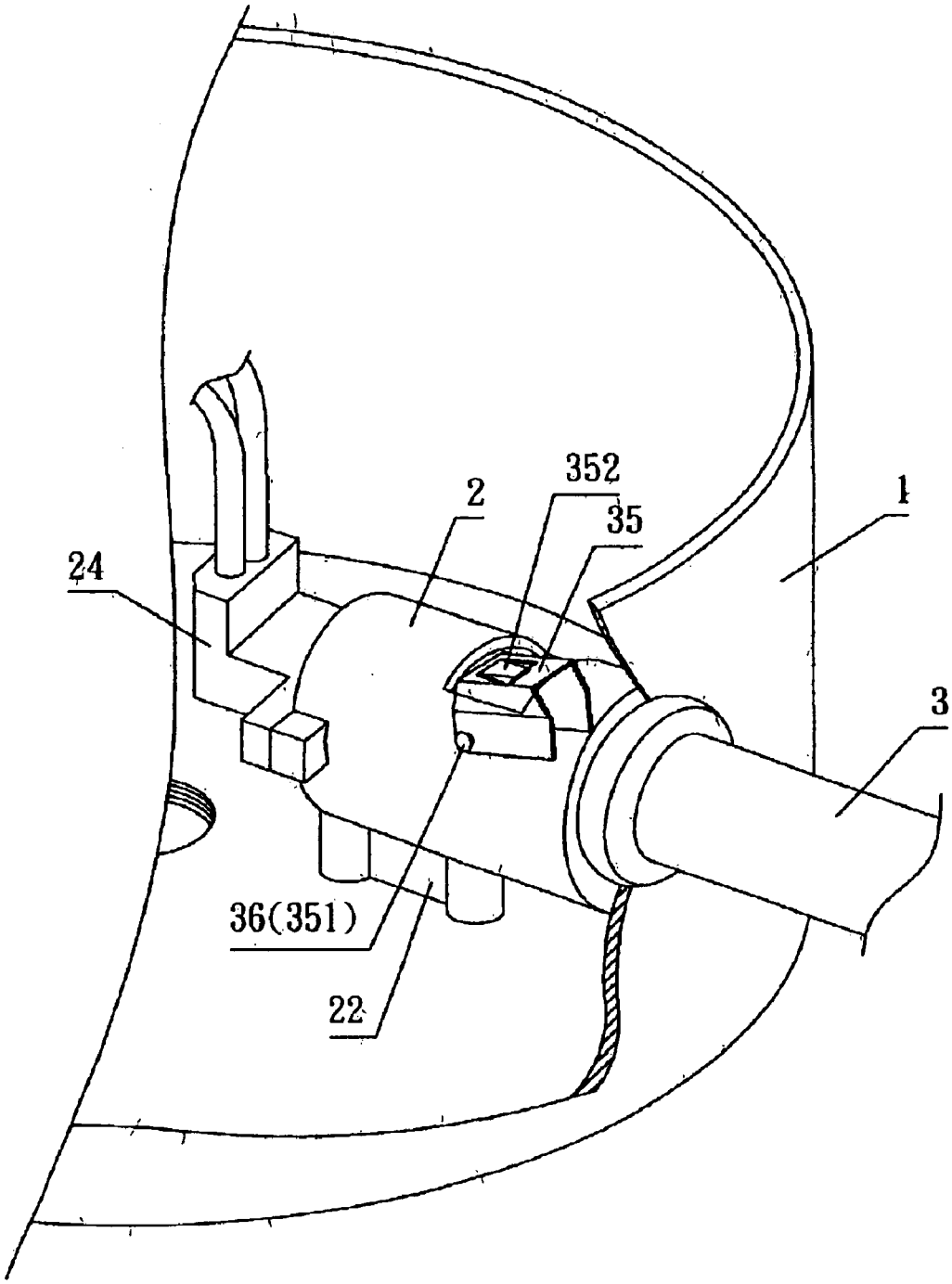
FIG. 2 is an assembled perspective view of the present invention.
Figure 4:
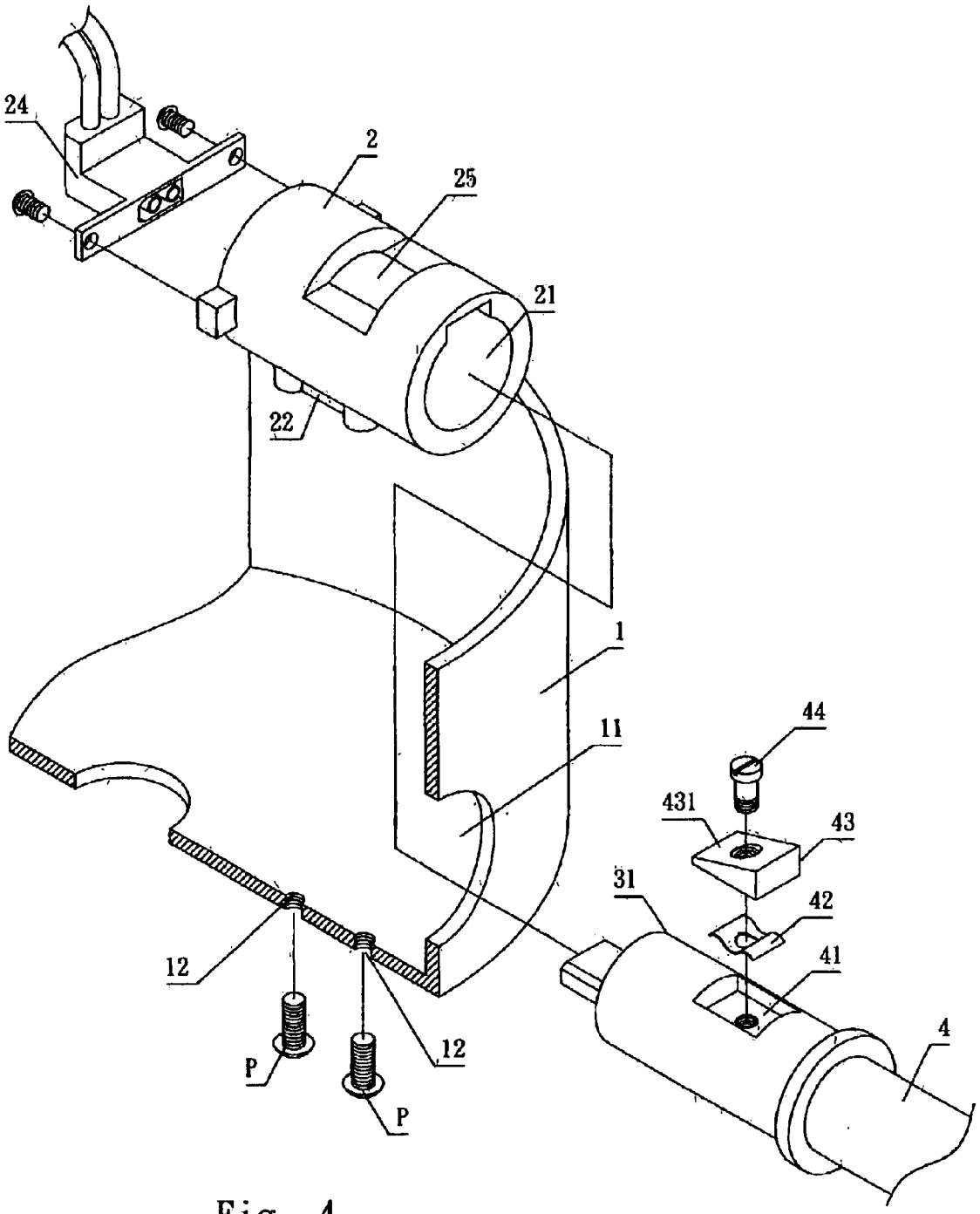
FIG. 4 shows another embodiment of the present invention.

Referring to FIGS. 1 and 2, the device of the present invention is illustrated. The present invention includes a lamp seat 2 firmly secured to a lateral side of a wire winding box 1, and a lamp rod 3 inserted into the lamp seat 2.

A lateral side of the wire winding box 1 has a via hole 11 and a bottom of the wire winding box 1 coupled to the lamp seat 2 has a plurality of through holes 12 for being passed by a stud P so as to lock the lamp seat 2 to a predetermined positioned.

A portion of the lamp seat 2 coupled to the via hole 11 of the wire winding box 1 has a penetrating hole 21. A bottom of the lamp seat 2 is protruded with a locking seat 22 which is coupled to the through holes 12 of the wire winding box 1 so that studs P pass through the through holes 12 from a lower end of the wire winding box 1 and then are locked to the locking seat 22 so as to fix the lamp seat 2 to the wire winding box 1. An axial recess 23 is formed in an inner surface of the penetrating hole 21 so that as the lamp rod 3 is inserted, it can be buckled in the axial recess 23. A distal end of the lamp seat 2 is locked with an inserting seat 24 for positioning the end portion 31 of the lamp rod 3. A top of the lamp seat 2 has an embedding hole 25 for positioning the lamp rod 3 as it inserts into the lamp seat 2.

A front end of the lamp rod 3 has an end portion 31 with a size exactly inserted into the inserting seat 24. The lamp rod 3 has a positioning block 32 at a position corresponding to the axial recess 23 of the lamp seal 2. The positioning block 32 exactly passes through the axial recess 23. The two lateral sides and upper surface of the lamp rod 3 are further formed with a reduced portion 33. One lateral side of the reduced portion 33 is formed with a positioning hole 34. A U shapes embedding block 35 covers upon the reduced portion 33. The U shape embedding block 35 has a through hole 351 at a position corresponding to the positioning hole 34. Thereby, a pin 36 passes through the through hole 351 and the positioning hole 34 so as to fix the embedding block 35 to the reduced portion 35. A top center of the embedding block 35 has an elastomer 352. When the lamp rod 3 inserts into the lamp seat 2, the elastomer 352 will eject the embedding block 35 upwards. Thereby, the embedding block 35 will be buckled to the embedding hole 25. When the lamp rod 3 is inserted into the lamp seat 2, the end portion 31 of the lamp rod 3 exactly inserts into the inserting seat 24 so that the lamp seat 2 is conductive to the lamp rod 3.

The operation of the present invention will be described here. At first, the positioning block 32 of the lamp rod 3 is aligned to the axial recess 23 and then is inserted into the lamp seat 2. Moreover, the embedding block 35 at the topside of the lamp rod 3 is pressed by the penetrating hole 21 so as to press the elastomer 352 to move downwards (referring to FIG. 3B). When the lamp rod 3 is inserted into the lamp seat 2 so that the embedding block 35 is aligned to the embedding hole 25 of the lamp seat 2, since the elastomer 352 is released, by the resilient force of the elastomer 352, another end of the embedding block 35 will eject upwards so that the ejecting end of the embedding block 35 exactly buckles to the embedding hole 25 of the lamp seat 2 (referring to FIG. 3C). As a result, the lamp rod 3 is substantially positioned in the lamp seat 2.

With reference to FIGS. 4, 5A, 5B and 5C, another embodiment of the present invention is illustrated. The top of the lamp rod 4 has a receiving groove 41. A wave-like reed 42 and a buckle 43 are locked in the receiving groove 41 by a stud 44. The buckle 43 has an inclined surface 431. When the lamp rod 4 is inserted into the lamp seat 2, the inclined surface 431 of the buckle 43 at the top of the lamp rod 4 is pressed by the penetrating hole 21 of the lamp seat 2 so that the reed 42 moves downwards (referring to FIGS. 5A and 5B). When the lamp rod 4 is inserted into the lamp seat 2 completely so that the buckle 43 is aligned with the embedding hole 25, since the reed 42 is released, by the resilient force of the reed 42, the buckle 43 will eject upwards so that the ejecting end of the buckle 43 exactly buckles to the embedding hole 25 of the lamp seat 2 (referring to FIG. 5C). As a result, the lamp rod 4 is substantially positioned in the lamp seat 2.

By above said structure, in transferring or storage, the lamp rod and the wire winding box 1 can be detached in advance so as to reduce the volume. In use, the user only needs to insert the lamp rod into the lamp seat 2 without using any locking tools. Thus, the user can assemble the lamp by himself (or herself).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What are claimed is:

1. A detachable lamp assembly device comprising a lamp seat firmly secured to a lateral side of a wire winding box, and a lamp rod inserted into the lamp seat; wherein a lateral side of the wire winding box has a via hole; a portion of the lamp seat coupled to the via hole of the wire winding box has a penetrating hole; a distal end of the lamp seat is locked with an inserting seat for positioning an end portion of the lamp rod; a top of the lamp seat has an embedding hole for positioning the lamp rod as the lamp rod inserts into the lamp seat;

a front end of the lamp rod has an end portion with a size exactly inserted into the penetrating hole of the inserting seat; a U shape reduce portion is formed at two lateral sides and an upper surface of the lamp rod; one lateral side of the reduced portion is formed with a positioning hole; a U shape embedding block covers upon the reduced portion; the U shape embedding block has a through hole at a position corresponding to the positioning hole; thereby, a pin passes through the through hole and the positioning hole so as to fix the embedding block to the reduced portion; a top center of the embedding block has an elastomer; when the lamp rod inserts into the lamp seat, the elastomer will eject the embedding block upwards; thereby, the embedding block will be buckled to the embedding hole; when the lamp rod is inserted into the lamp seat, the end portion of the lamp rod exactly inserts into the inserting seat so that the lamp seat is conductive to the lamp rod, thereby, a user can assemble the lamp rod by inserting it into the lamp seat easily; thus, the lamp is detachable for storage and transfer with a smaller volume.

2. The detachable lamp assembly device as claimed in claim 1, wherein an axial recess is formed in an inner surface of the penetrating hole so that as the lamp rod is inserted, the lamp rod is buckled in the axial recess; the lamp rod has a positioning block at a position corresponding to the axial recess of the lamp seat; in assembly, the positioning block exactly passes through the axial recess.

3. The detachable lamp assembly as claimed in claim 1, wherein a bottom of the lamp seat is protruded with a locking seat which is coupled to a plurality of through holes at a bottom of the wire winding box; and a stud passes through the through holes from a lower end of the wire winding box and then is locked to the locking seat so as to fix the lamp seat to the wire winding box.

4. A detachable lamp assembly device comprising a lamp seat firmly secured to a lateral side of a wire winding box, and a lamp rod inserted into the lamp seat; wherein a lateral side of the wire winding box has a via hole; a portion of the lamp seat coupled to the via hole of the wire winding box has a penetrating hole; a distal end of the lamp seat is locked with an inserting seat for positioning the end portion of the lamp rod; a top of the lamp seat has an embedding hole for positioning the lamp rod as the lamp rod inserts into the lamp seat;

a front end of the lamp rod has an end portion with a size exactly inserted into the penetrating hole of the inserting seat; a top of the lamp rod has a receiving groove; a wave-like reed and a buckle are locked in the receiving groove by a stud; the buckle has an inclined surface;

wherein when the lamp rod is inserted into the lamp seat completely so that the buckle is aligned with the embedding hole; by the resilient force of the reed, the buckle will eject upwards so that the ejecting end of the buckle exactly buckles to the embedding hole of the lamp seat and thus the lamp rod is substantially positioned in the lamp seat.

* * * * *